US006320168B1

(12) United States Patent
Kimata et al.

(10) Patent No.: US 6,320,168 B1
(45) Date of Patent: Nov. 20, 2001

(54) INDUCTION-HEATING FUSION DEVICE

(75) Inventors: Akinori Kimata, Toyohashi; Takahiro Tsujimoto, Toyokawa, both of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/613,898

(22) Filed: Jul. 11, 2000

(30) Foreign Application Priority Data

Jul. 15, 1999 (JP) ..... 11-202022

(51) Int. Cl.[7] ..... H05B 6/40; H05B 6/14; G03G 15/20

(52) U.S. Cl. ..... 219/619; 219/662; 219/672; 399/330; 399/335

(58) Field of Search ..... 219/619, 661, 219/662, 665, 672; 399/328, 329, 330, 334, 335, 336

(56) References Cited

U.S. PATENT DOCUMENTS 5,250,777 * 10/1993 Fishman ..... 219/619
5,778,293 * 7/1998 Ohtsuka ..... 399/329
5,819,150 * 10/1998 Hayasaki et al. ..... 399/330
6,122,477 * 9/2000 Parker ..... 399/330

FOREIGN PATENT DOCUMENTS 10-31389 2/1998 (JP) .

* cited by examiner

*Primary Examiner*—Philip H. Leung
(74) *Attorney, Agent, or Firm*—McDermott, Will & Emery

(57) ABSTRACT

The present invention has an object to provide an induction-heating fusion device which is capable of stabilizing the fusing temperature over the entire width of a sheet therethrough by inhibiting an excessive temperature rise in a sheet-nonpassing zone defined when a small-size sheet is subjected to fusion. The induction-heating fusion device according to the present invention includes an iron core 17 forming a closed magnetic circuit, a main induction coil 14*a* wound around the iron core 17 for generating a magnetic flux which causes an electrically conductive member to generate an induction current circumferentially thereof, and at least one induction sub-coil 14*b* provided on an end portion of the main coil for generating a magnetic flux which causes the electrically conductive member to generate an induction current circumferentially thereof.

21 Claims, 13 Drawing Sheets

INDUCTION-HEATING FUSION DEVICE

RELATED APPLICATION

This application is based on application No. H11-202022 filed in Japan, the entire content of which is hereby incorporated by reference.

BACKGROUND OF THE INVENTION

1. Field of the Invention

The present invention relates to fusion devices for use in, for example, electrophotographic copying machines, printers and facsimile apparatus, and more particularly, to a fusion device adapted to fuse toner images onto a recording medium by utilizing low-frequency induction heating.

2. Description of the Related Art

In an image forming apparatus such as an electrophotographic copying machine, printer or facsimile apparatus, there is provided a fusion device adapted to fuse toner images onto a recording medium such as a paper sheet or a transfer material carrying the same.

Although various types of fusion devices exist, there have been proposed induction-heating type fusion devices which exhibit a higher energy conversion efficiency than fusion devices of the type having a halogen lamp as a heat source, as devices satisfying the recent energy saving demand.

An induction-heating type fusion device as disclosed in, for example, Japanese Unexamined Patent Publication No. HEI 10-207265 includes a fixed or movable electrically conductive member of a hollow configuration, an iron core forming a closed magnetic circuit and having a portion inserted into the hollow portion of the electrically conductive member, and an induction coil wound around the iron core forming the closed magnetic circuit, wherein current is passes through the induction coil to generate a magnetic flux which causes the electrically conductive member to generate an induced current along the circumference of the electrically conductive member, thereby induction-heating the electrically conductive member.

Since an image forming apparatus forms images on sheets of different sizes, a fusion device used therein has to perform fusion with respect to sheets of different sizes.

When a small-size sheet is passed through the aforementioned prior art induction-heating fusion device, a sheet-nonpassing zone results through which the sheet does not pass. Since this sheet-nonpassing zone fails to allow heat to escape through the sheet, the temperature is elevated markedly, which causes the permeability of the iron core to vary, thus resulting in an unstable fusion temperature. In addition, such an excessive temperature rise in the nonpassing zone also facilitates deterioration of the device components such as the induction coil and electrically conductive member in that zone.

The prior art induction-heating fusion device has opposite end portions which are cooled more rapidly than a central portion and hence is designed to heat a wider extent than the maximum sheet width of usable sheets so that even a sheet having the maximum sheet width can entirely be heated uniformly. For this reason, the induction coil is required to have a larger length than the maximum sheet width. Thus, the prior art induction-heating device also involves a problem of an increased device size.

SUMMARY OF THE INVENTION

Accordingly, it is an object of the present invention to provide an induction-heating fusion device which is capable of stabilizing the fusing temperature over the entire width of a sheet to be passed therethrough by inhibiting an excessive temperature rise in a sheet-nonpassing zone defined, for example, when a small-size sheet passes through the device.

A second object of the present invention is to provide an induction-heating fusion device which is capable of maintaining a fusion-suited temperature over an extent from a central portion to opposite end portions of the device with the use of an induction coil having a coil length substantially equal to the maximum sheet width of usable sheets.

These and other objects are attained by an induction-heating fusion device comprising: an electrically conductive tube; an endless belt covering the tube; a pressure member pressed toward the heat-generating member to define a nip in cooperation with the endless belt; a permeable closed loop having a portion inserted into the tube; a main coil continuously wound around the inserted portion of the closed loop along a peripheral wall of the tube and extending along the length of the tube; a first sub-coil continuously wound around the inserted portion of the closed loop on an end portion of the tube along the peripheral wall of the tube; and a controller for controlling application of current to the main coil from a power source and application of current to the first sub-coil from the power source.

The aforementioned objects of the present invention can also be attained by the above induction-heating fusion device further comprising a second sub-coil continuously wound around the inserted portion of the closed loop on an end portion of the tube along the peripheral wall of the tube, wherein: the second sub-coil is wound around the main coil in an overlapping fashion to a length corresponding to a sheet-nonpassing zone defined when a third standardized sheet which is smaller than the first standardized sheet and larger than the second standardized sheet in width passes through the nip; and when the first standardized sheet passes through the nip, the controller causes alternating current to pass through the main coil while causing alternating current to pass through the second sub-coil constantly in a same direction as that passing through the main coil, and when the third standardized sheet passes through the nip, the controller causes alternating current to pass through the main coil only.

Alternatively, the aforementioned objects are attained by an induction-heating fusion device comprising: an electrically conductive hollow member; an iron core forming a closed loop and having a portion inserted into a hollow portion of the electrically conductive member; a main coil spirally wound around the inserted portion of the iron core along an internal wall of the electrically conductive member; and a first sub-coil continuously wound around the inserted portion of the iron core along the internal wall of the electrically conductive member, wherein the main coil and the sub-coil cause the electrically conductive member to generate induction heat when applied with alternating current.

The aforementioned objects of the present invention can also be attained by the above induction-heating fusion device further comprising a first switch for switching the direction of current passing through the first sub-coil into a direction as same as or opposite to the direction of current passing through the main coil constantly.

The aforementioned objects of the present invention can also be attained by the above induction-heating fusion device further comprising a second sub-coil spirally wound around the inserted portion of the iron core along the internal wall of the electrically conductive member.

Alternatively, the aforementioned objects of the present invention are attained by a fusion device which generates heat by applying current to a coil to cause an electrically conductive member to generate induction current, comprising: an iron core; an electrically conductive member having an endless configuration in section and covering the iron core; a main coil wound around the iron core within the endless configuration of the electrically conductive member for generating a magnetic flux which causes the electrically conductive member to generate an induction current circumferentially thereof; and a sub-coil wound around an end portion of the iron core within the endless configuration of the electrically conductive member for generating a magnetic flux which causes the electrically conductive member to generate induction current circumferentially thereof.

The aforementioned objects of the present invention can also be attained by the above fusion device further comprising a switch for switching the direction of current passing through the sub-coil so that the sub-coil is excited in a direction as same as or opposite to an excited direction of the main coil.

The aforementioned objects of the present invention can also be attained by the above fusion device further comprising a controller for controlling the switch depending on the size of a sheet to passing through the fusion device and/or the fusing temperature.

The invention itself, together with further objects and attendant advantages, will be best be understood by reference to the following detailed description taken in conjunction with the accompanying drawings.

BRIEF DESCRIPTION OF THE DRAWINGS

In the following description, like parts are designated by like reference numbers throughout the several drawings.

DESCRIPTION OF THE PREFERRED EMBODIMENTS

The present invention will now be described in detail by way of illustrative embodiments thereof with reference to the accompanying drawings.

EMBODIMENT 1

Figure 1:
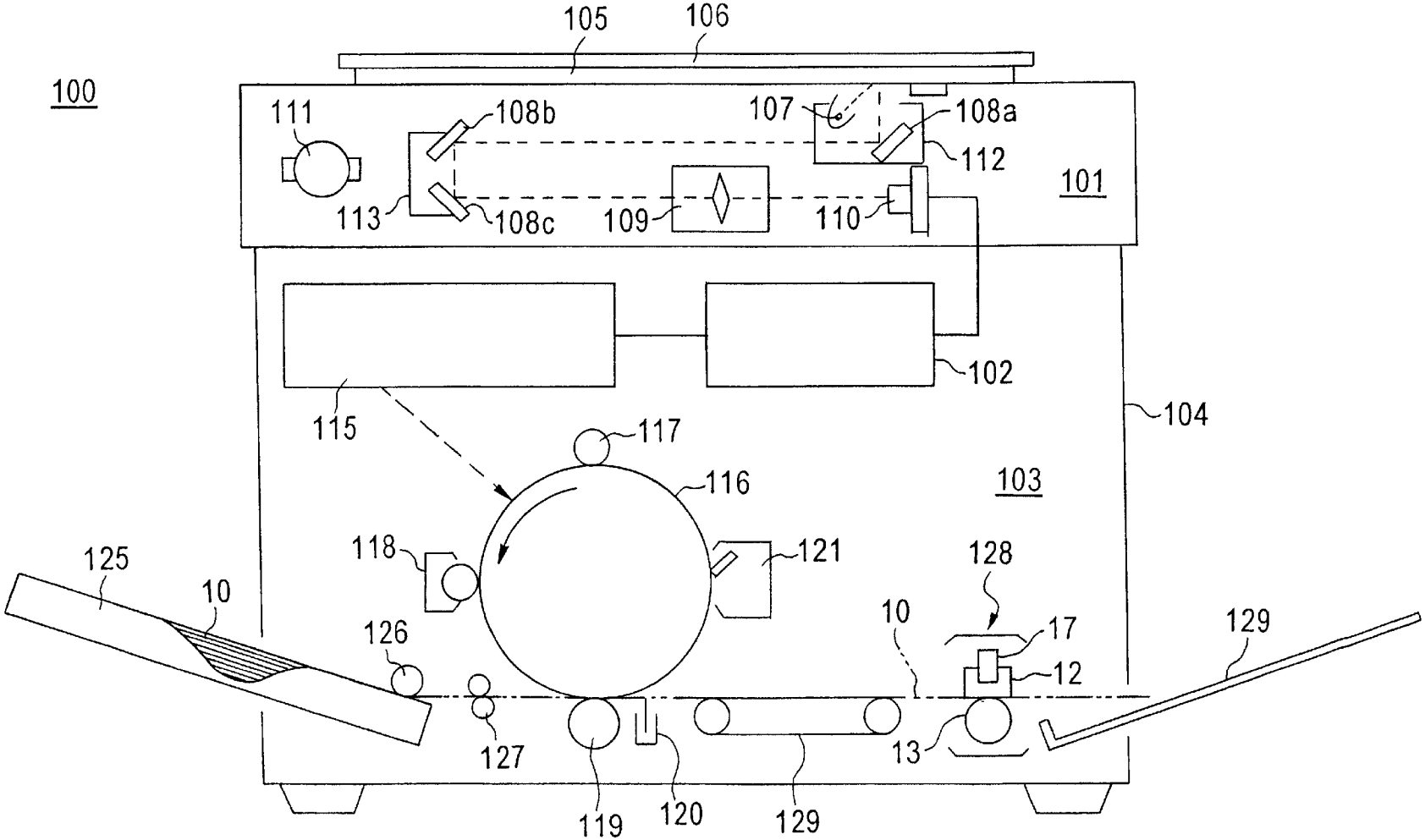
FIG. 1 is a schematic view illustrating a copying machine provided with an induction-heating fusion device according to the present invention.

FIG. 1 is a schematic view illustrating a copying machine 100 as an image forming apparatus incorporating an induction-heating fusion device according to the present invention.

As shown, the copying machine 100 includes an image scanner section 101 for scanning an original document, a signal processing section 102 for processing signals, a printer section 103 for outputting to a sheet 10 as a recording medium the print of an image equivalent to the image of the original document resulting from the scanning at the image scanner section 101, and a casing 104 in which these sections are disposed or accommodated.

In the image scanner section 101, the original document placed on a platen glass 105 is pressed by a platen cover 106 which may be replaced with an automatic original document feeder not shown, as the case maybe. The original document on the platen glass 105 is illuminated by a lamp 107, and light reflected by the original document forms an image on a CCD line image sensor 110 through mirrors 108*a*, 108*b* and 108*c* and a condenser lens 109. The image thus formed is converted into image information which in turn is fed to the signal processing section 102. When a scanner motor 111 is driven, first and second sliders 112 and 113 are mechanically moved in a feed direction, or a direction perpendicular to the electrical scanning direction (scanning direction) to scan the original document entirely. The first slider 112 moves at a speed of v, while the second slider 113 moves at a speed of v/2.

The signal processing section 102 electrically processes the signals read by the line sensor 110 and feeds them to the printer section 103.

The printer section 103 includes a laser generator 115 and a photosensitive drum 116 as an image carrier. Around the photosensitive drum 116 rotating, there are disposed a static charger roller 117 as an electrostatically charging device, a transfer roller 119 as a transfer device, a destaticizing needle 120 as a device for destaticizing the sheet 10 and parting the sheet 10 from the drum 116, and a cleaning device 121 for removing residual toner from the photosensitive drum 116. The laser generator 115 actuates and modulates a semiconductor laser device in accordance with the level of a picture signal fed from the signal processing section 102. Laser beam advances via optical components (not shown) such as a polygon mirror, an f-θ lens and a folding mirror to a location between the static charger roller 117 and a developing device 118 at which the photosensitive drum 116 is illuminated by the laser beam. An electrostatic latent image formed on the photosensitive drum 116 is developed by the developing device 118 with use of toner.

On the other hand, a paper feed cassette 125 removably attached to the casing 104 stores therein a plurality of sheets 10 in a stacked condition. The sheets 10 in the paper feeding cassette 125 are fed separately one by one by a paper feeding roller 126 and sent to a transfer position between the photosensitive drum 116 and the transfer roller 119 with a predetermined timing by means of a timing roller 127. The image developed on the photosensitive drum 116 is transferred to sheet 10 by means of the transfer roller 119. After the transfer, the sheet 10 is parted from the photosensitive drum 116 and conveyed to a fusion device 128 by means of a conveyor belt 129. In the fusion device 128, the unfused toner transferred onto the sheet 10 is fused and fixed. The sheet 10 carrying the toner thus fused is ejected onto an ejection tray 129. It is to be noted that the fusion device 128 of the subject embodiment is of a low-frequency induction-heating type of which the construction will be described later.

When the transfer of the image to the sheet 10 by means of the transfer roller 119 is completed, the photosensitive drum 116 is negatively charged by a pre-cleaner charger (not shown), and then residual toner and residual electrostatic charge on the photosensitive drum 116 are eliminated by the cleaning device 121 and an eraser, respectively. The photosensitive drum 116 thus cleaned and destaticized is again electrostatically charged by the static charger roller 117, and illuminated by laser beam to form a latent image, which in turn is developed by the developing device 118. Static charge on the undeveloped region of the photosensitive drum 116 is eliminated by a pre-transfer eraser (not shown).

Figure 2:
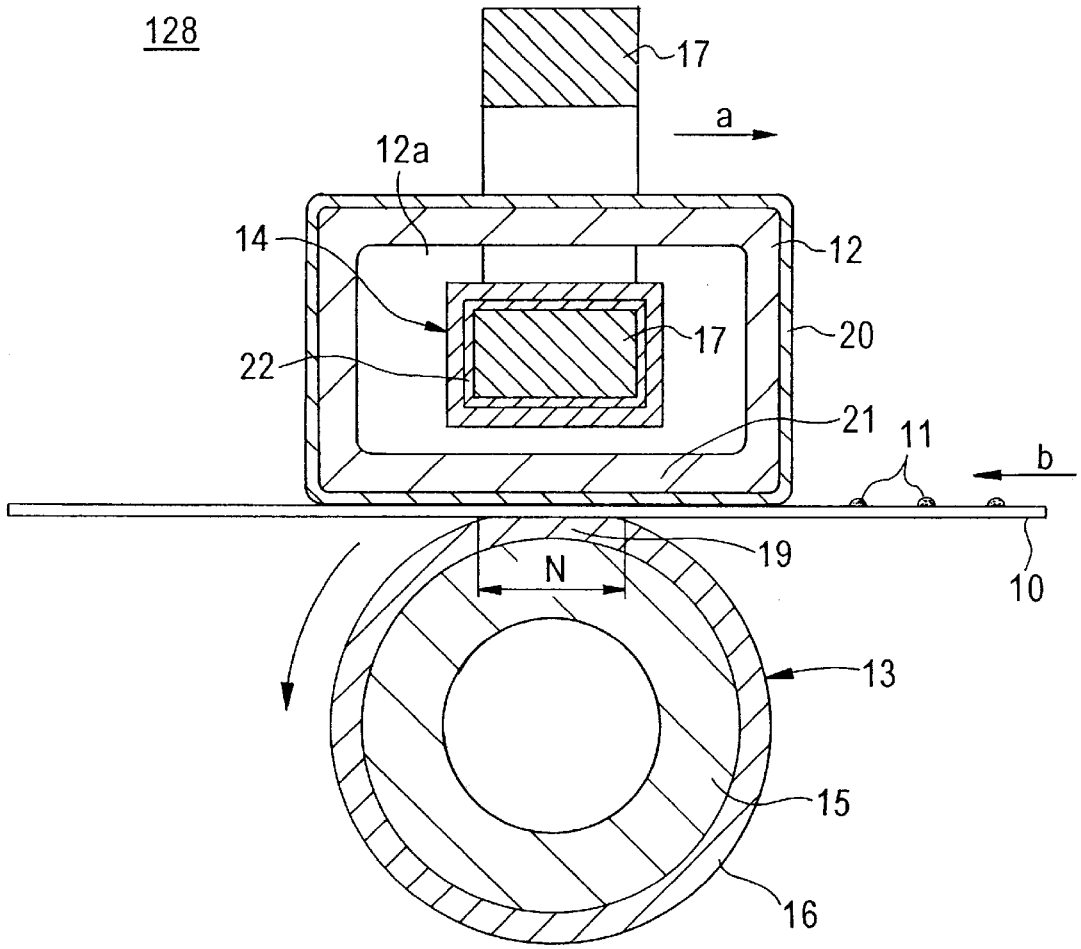
FIG. 2 is a schematic view illustrating the construction of the induction-heating fusion device.
Figure 3:
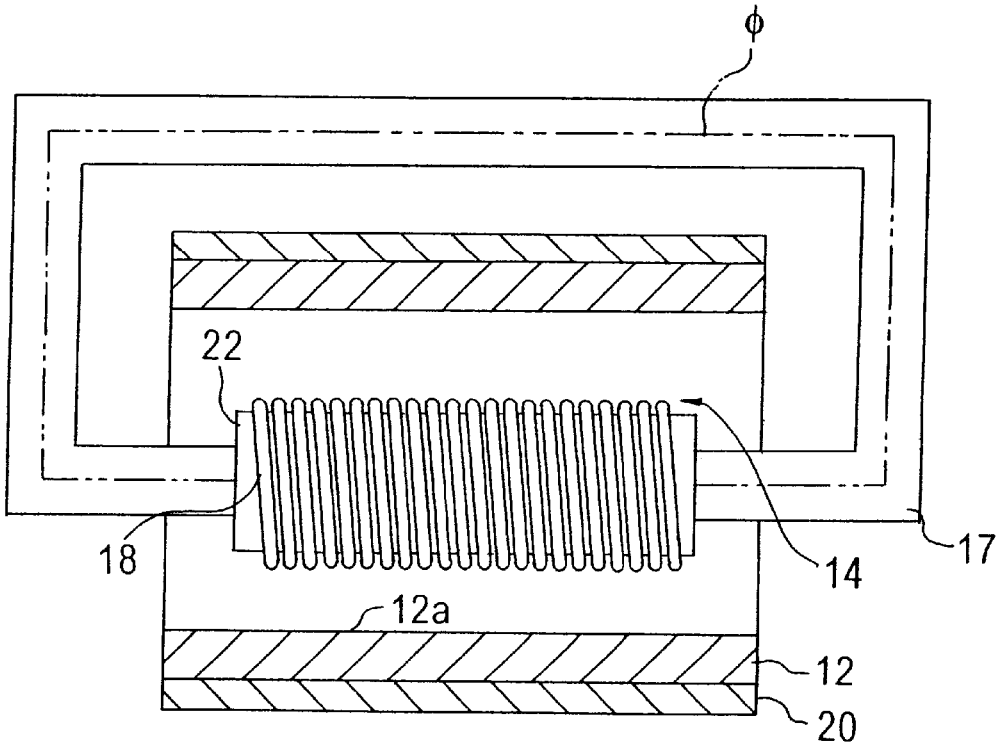
FIG. 3 is a sectional view illustrating a relevant part of the induction-heating fusion device.

FIG. 2 schematically illustrates the construction of the induction-heating fusion device, and FIG. 3 illustrates a principal part of the device in section.

The induction-heating fusion device 128 functions to heat and fuse toner 11 carried on the sheet 10 for fixing the toner 11 to the sheet 10, and includes a hollow temperature raising member (equivalent to the electrically conductive member) 12 fixed so as not to rotate, a pressure roller (equivalent to the pressure member) 13 adapted to bring the toner-carrying sheet 10 into close but indirect contact with the temperature raising member 12, a conveyor belt 20 intervening between the fixed temperature raising member 12 and the pressure roller 13 for conveying the sheet 10, and a coil 14 for induction-heating the temperature raising member 12. As will be described later, the coil 14 comprises a first induction coil 14*a* and a second induction coil 14*b* (refer to FIG. 4).

The conveyor belt 20 is movable in the direction indicated by arrow (a) in FIG. 2, and as the conveyor belt 20 moves together with the sheet 10, the pressure roller 13 is driven to rotate.

The temperature raising member 12 comprises an electrically conductive hollow pipe formed of, for example, carbon steel, stainless alloy, aluminum or iron and has a wall thickness such as to ensure a sufficient mechanical strength against the pressure imposed by the pressure roller 13 and a desired heat capacity. The opposite ends of the temperature raising member 12 are fixed to the frame of a fusion unit (not shown). Particularly, the temperature raising member 12 is shaped rectangular having a flat portion 3 forming a surface facing opposite to the pressure roller 13. The flat portion 21 enlarges a nip width or nip zone (N) defined between the temperature raising member 12 and the pressure roller 13.

The pressure roller 13 comprises a roller core 15 and a silicone rubber layer 16 formed on the periphery of the roller core 15. The silicone rubber layer 16 has a releasability for allowing the sheet 10 to be released from the surface of the rubber layer 16 and a heat resistance. The pressure roller 13 is pressed toward the temperature raising member 12 by means of a spring (not shown).

The conveyor belt 20 is trained around the outer periphery of the rectangular temperature raising member 12 and abuts a driving roller (not shown). A driving source (not shown) such as a motor connected to the driving roller causes the conveyor belt 20 to revolve as guided by the temperature raising member 12. The conveyor belt 20 is formed of an insulator such as a flexible heat-resistant resin so as not to generate heat by induction. The outer peripheral surface of the conveyor belt 20 is coated with a fluoroplastic to form a release layer having favorable releasability and a heat resistance with respect to toner thereby facilitating release of the sheet 10 from the conveyor belt 20.

The induction-heating fusion device 128 further includes a rectangular core (equivalent to the closed magnetic circuit iron core) 17 forming a closed magnetic circuit and having a portion extending through a hollow portion 12*a* of the temperature raising member 12. The core 17 is a so-called "iron core" which can be used in an ordinary transformer and is preferably comprises a highly permeable material such as a silicon steel sheet stacked core.

Figure 4:
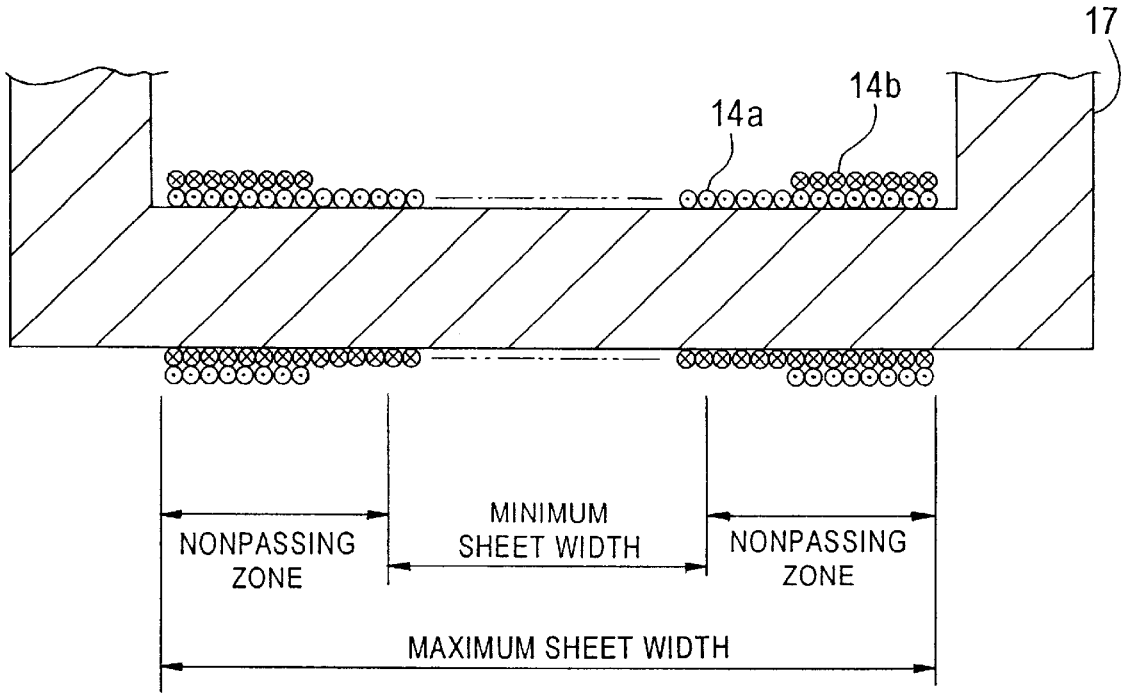
FIG. 4 is a fragmentary sectional view illustrating a coil section of an induction-heating fusion device according to EMBODIMENT 1 of the present invention.

FIG. 4 is a fragmentary sectional view showing a coil section of EMBODIMENT 1.

The coil 14 comprises the first induction coil 14*a* (main induction coil, hereinafter the same) and the second induction coil (induction sub-coil, hereinafter the same), both of which are fitted around the core 17 and are located within the temperature raising member 12. The first induction coil (main induction coil) 14*a* is wound to a length equivalent to the maximum sheet width, while the second induction coil (induction sub-coil) 14*b* is wound around opposite end portions of the core 17 other than a portion corresponding to the minimum sheet width. These coils 14*a* and 14*b* are each formed by spirally winding a wire 18. The winding direction of one coil is opposite to that of the other. This feature will be described in detail later.

The wire 18 forming the coils 14*a* and 14*b* comprises a single ordinary conductor wire having a fused layer and an insulating layer at a surface thereof. A heat-insulating layer 22 is formed in the coil 14 to prevent heat generated at the temperature raising member 12 or the coil 14 from transferring to the core 17.

The fusion device of the construction described above basically operates as follows. First, when the coil 14 is applied with an alternating current of about 50 to 60 Hz from the power source circuit, a magnetic flux is generated at the core 17 to cause the temperature raising member 12 to generate induction current circumferentially of the temperature raising member 12. Thus, the temperature raising member 12 is heated to a suitable temperature for fusion, for example, 150° to 200° C. by low-frequency induction. The sheet 10 carrying unfused toner 11 is conveyed in the direction indicated by arrow (b) from the right-hand side in FIG. 2 toward a nip section 19 where the pressure roller 13 is pressed against the temperature raising member 12. In the conveyance, the sheet 10 is nipped at the nip section 19 while undergoing the heat of the temperature raising member 12 heated and the pressure of the pressure roller 13. Thus, the unfused toner 11 is fused to the sheet 10. The toner 11 is carried by the sheet 10 on the side contacting the conveyor belt 20. The sheet 10 past the nip section 19 is conveyed toward the left-hand side in FIG. 2 as automatically released from the conveyor belt 20 by the nerve of itself. The sheet 10 is then ejected onto the ejection tray 129 by means of a sheet-ejecting roller.

The principle on which the induction-heating fusion device thus constructed operates is similar to that of a transformer. Specifically, the coil 14 is equivalent to a primary coil (n turns) on the input side, and the temperature raising member 12 is equivalent to a secondary coil (1 turn) on the output side. When the primary coil (coil 14) is applied with alternating voltage V1 of about 50 to 60 Hz, current I1 passes through the primary coil to generate a magnetic flux $\phi$ passing through the core 17 forming the closed magnetic circuit. The magnetic flux $\phi$ gives rise to induced electromotive force V2 at the secondary coil (temperature raising member 12), so that current I2 is generated circumferentially of the temperature raising member 12. Since the core 17 forms the closed magnetic circuit, a leakage flux does not occur theoretically and, hence, the energy V1×I1 on the primary side generally equals the energy V2×I2 on the secondary side.

In the induction-heating system, heat generation occurs as the first heat generation at the primary coil, i.e., the coil 14 which itself generates heat based on a copper loss of the copper wire forming the primary coil, as the second heat generation at the secondary coil, i.e., the temperature raising member 12 which generates heat by induction based on a copper loss of the copper wire of the secondary coil, and as the third heat generation at the core 17 which generates heat based on a Joule heat loss and a hysteresis loss that occur in the core 17. The induction-heating fusion device is designed to minimize the first and third heat generations which become heat losses while causing the temperature raising member 12 to generate heat efficiently by utilizing a copper loss of the secondary coil.

Figure 5:
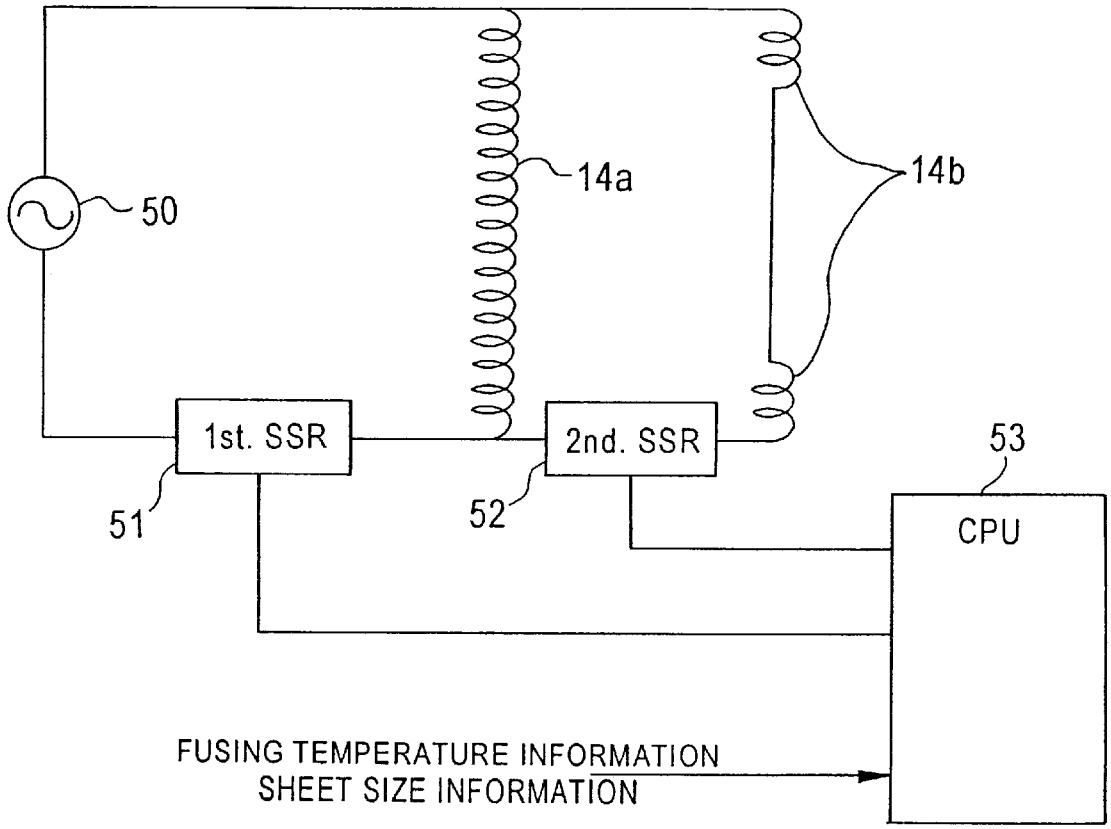
FIG. 5 is a diagrammatic view of a power supply circuit in the induction-heating fusion device according to EMBODIMENT 1.

FIG. 5 illustrates a circuit configuration for supplying electric power to the first induction coil 14*a* and the second induction coil 14*b*.

As shown, the first and second induction coils 14*a* and 14*b* are connected parallel to each other. A first SSR (solid state relay) 51 serving as a switch is provided between the first induction coil 14*a* and a power source 50, and a second SSR 52 is provided between the first and second induction coils 14*a* and 14*b*. These SSRs 51 and 52 are connected to a CPU 53 serving as the control means.

The SSR are used here because they prevent entry of noise from a utility power, which is directly used as the power to be supplied to the induction coils, into such electric systems as the CPU and other control systems, and because, in case of failure or the like, they prevent direct entry of the utility power into other electric systems. It should be noted that instead of an SSR can be used any device which can control the electric system of the induction coils electrically separately from any other electric system, for example, a photocoupler.

The CPU 53 performs switching of the first and second SSRs 51 and 52 on the basis of information including fusion temperature information from a temperature sensor (not shown) adapted to detect the temperature of the fusion device and sheet size information from a sheet size sensor (not shown) adapted to detect the width of a sheet.

When both the first and second SSRs 51 and 52 are turned on by the CPU 53, current passes through the first and second induction coils 14*a* and 14*b* in the same direction.

Since the first and second induction coils 14*a* and 14*b* are wound in opposite directions as described above, they are excited in opposite directions to generate magnetic fluxes that offset each other when both the coils are applied with current.

When a sheet of a small size is coming, the CPU 53 causes both the first and second SSRs 51 and 52 to be turned on in response to information from the sheet size sensor so that both the first and second induction coils 14*a* and 14*b* are applied with current. Accordingly, respective magnetic fluxes generated at the first and second induction coils 14*a* and 14*b* offset each other in a sheet-nonpassing zone (see FIG. 4) defined when the small-size sheet undergoes a fusing operation and, hence, the temperature raising member 12 does not generate heat by induction in this zone. Thus, an excessive rise in the temperature in the sheet-nonpassing zone is avoided.

EMBODIMENT 2

This embodiment is an arrangement in which the circuit configuration for supplying power to the induction coil is modified to allow the excited direction of the second induction coil to be switched into a direction as same as or opposite to the excited direction of the first induction coil. It should be noted that this embodiment is common to EMBODIMENT 1 described above in the overall construction of the copying machine as the image-forming apparatus, that of the fusion device and the like and, hence, the description of such common constructions and features are omitted.

Figure 6:
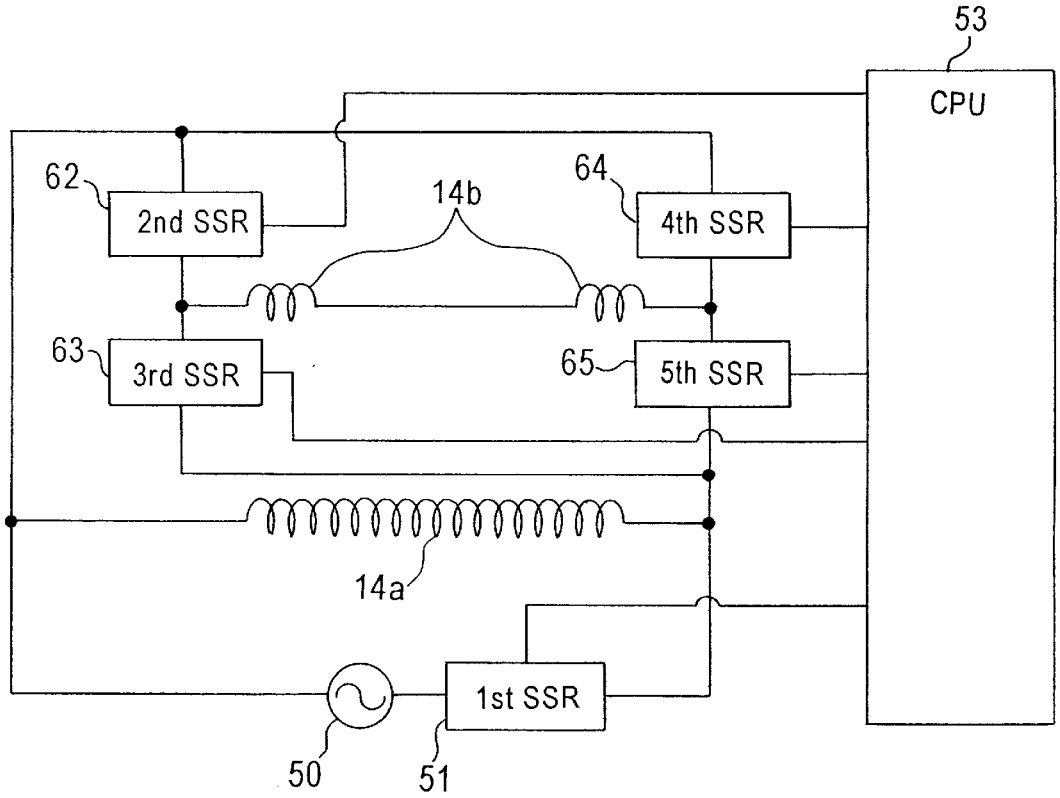
FIG. 6 is a diagrammatic view of a power supply circuit in an induction-heating fusion device according to EMBODIMENT 2.

FIG. 6 illustrates a power supply circuit configuration according to EMBODIMENT 2.

As shown, this circuit includes first SSR 51 for controlling power supply to the first induction coil 14*a*, and second to fifth SSRs 62 to 65 for controlling power supply to the second induction coil 14*b*. Switching of each of the SSRs 62 to 65 is controlled in response to a signal from the CPU 53 as in EMBODIMENT 1. The second induction coil 14*b* is wound in the same direction as the first induction coil 14*a*, and the coil length of the first induction coil 14*a* is equal to the maximum sheet width.

When the first SSR 51 as well as the second and fifth SSR 62 and 64 is turned on (while the third and fourth SSRs are off), current passes through the second induction coil 14 in the same direction as current passing through the first induction coil 14*a*, so that these coils are excited in the same direction. Accordingly, the opposite end portions in which the second induction coil 14*b* is located is more intensively induction-heated than the central portion. On the other hand, when the first SSR 51 as well as the third and fourth SSRs 63 and 65 is turned on (while the second and fifth SSRs are off), current passes through the second induction coil 14*b* in a direction opposite to that passing through the first induction coil 14*a*, so that these coils 14*a* and 14*b* are excited in opposite directions to each other. Accordingly, the opposite end portions in which the second induction coil 14*b* is located are induction-heated less intensively than the central portion.

When a sheet having the maximum width is coming, the CPU 53 turns the first SSR 51 as well as the second and fifth SSRs 62 and 64 on. By doing so, the opposite end portions are induction-heated more intensively than the central portion to avoid a temperature decrease in the opposite end portions though the coil length is equal to the maximum sheet width, thereby achieving uniform fusion over the entire sheet.

By contrast, when a small-size sheet is coming, the CPU 53 turns the first SSR 51 as well as the third and fourth SSRs 63 and 65 on. By doing so, the opposite end portions are induction-heated less intensively to prevent an excessive temperature rise in a sheet-nonpassing zone defined when such a small-size sheet is passed.

Since the coil length is equal to the maximum sheet width in EMBODIMENT 2, an excessive temperature rise in the opposite end portions in which a sheet-nonpassing zone is defined is naturally inhibited by the CPU 53 turning the first SSR 51 on and the second to fifth SSRs 62 to 65 off when a sheet having a width between the maximum sheet width and the minimum sheet width.

Figure 7:
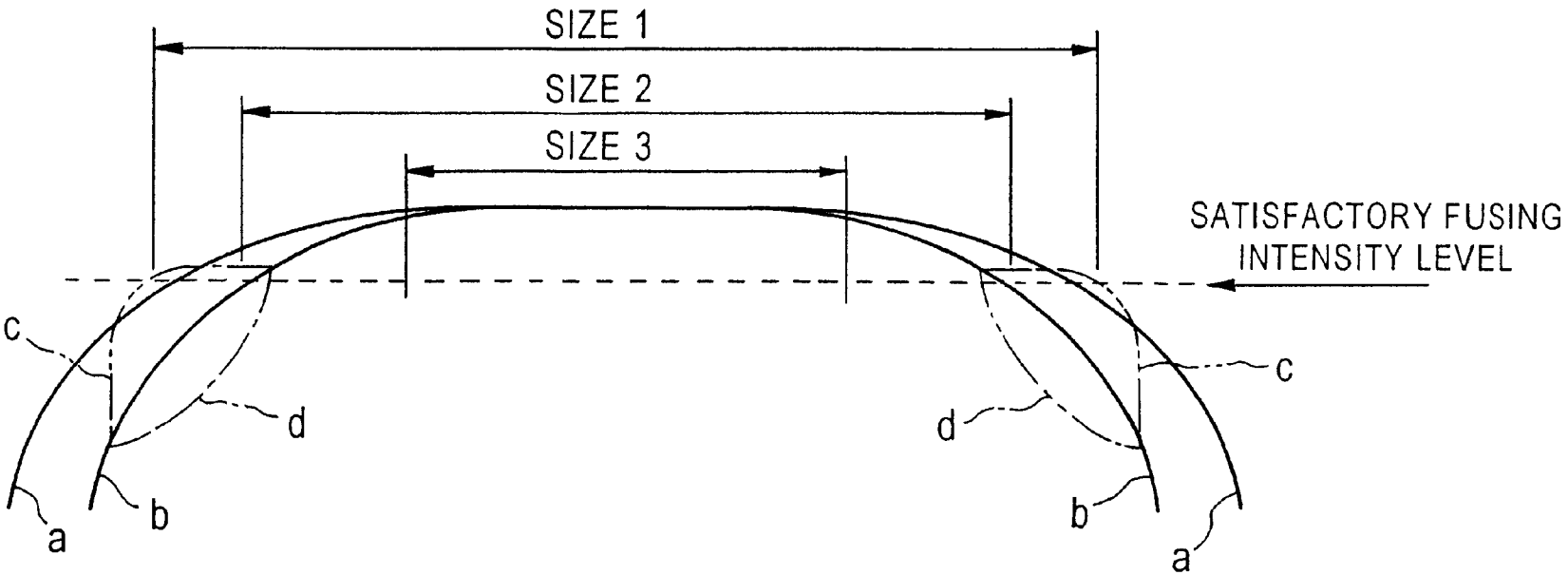
FIG. 7 is a diagrammatic view illustrating the relationship between the width of a sheet and the fusing temperature distribution.

FIG. 7 is a diagram showing the relationship between the sheet width and the fusion temperature distribution, wherein size 1 is the maximum sheet width, size 2 is smaller than the maximum sheet width, and size 3 is the minimum sheet width.

Curve (a) shown is a temperature distribution obtained when the coil length was made longer than the maximum sheet width to provide a uniform fusion temperature over the maximum sheet width as in the conventional art. Curve (b) is a temperature distribution obtained when induction heating was performed only by the first induction coil 14*a* having a coil length equal to the maximum sheet width in EMBODIMENT 2. Curve (c) is a temperature distribution obtained when the second induction coil 14*b* was excited in the same direction as the excited direction of the first induction coil 14*a*. Curve (d) is a temperature distribution obtained when the second induction coil 14*b* was excited in a direction opposite to the excited direction of the first induction coil 14*a*.

As seen from the curve (b), the temperature in the opposite end portions did not reach a satisfactory fusion intensity level (dotted line) when the coil length was equal to the maximum sheet width. For this reason, in the conventional art, the coil length is made longer than the maximum sheet width to reduce the influence of a temperature decrease in the opposite end portions like the curve (a) in preparation for achievement of fusion for a sheet of size 1.

EMBODIMENT 2 is an arrangement adapted to prevent a temperature decrease in the opposite end portions as seen from the curve (c) by exciting the second induction coil 14*b* in the same direction as the excited direction of the first induction coil 14*a*, so that even a sheet of size 1 can be subjected to a temperature ensuring the satisfactory fusion intensity level over the entire width thereof.

Further, as seen from the curve (b), EMBODIMENT 2 is capable of inhibiting an excessive temperature rise in the sheet-nonpassing zone defined in the opposite end portions when a sheet of size 2 is passed by failing to apply current to the second induction coil 14*b*, because the coil length is shorter than that in the conventional art.

Still further, as seen from the curve (d), EMBODIMENT 2 is capable of minimizing a temperature rise in the opposite end portions including a larger sheet-nonpassing zone defined when a smaller-size sheet, or sheet of size 3 is passed by exciting the second induction coil 14*b* in a direction opposite to the excited direction of the first induction coil to weaken the induction heat in the opposite end portions.

EMBODIMENT 3

EMBODIMENT 3 further includes a third induction coil (induction sub-coil) . It should be noted that this embodiment is common to EMBODIMENT 1 described above in the overall construction of the copying machine as the image-forming apparatus, that of the fusion device and the like and, hence, the description of such common constructions and features are omitted.

Figure 8:
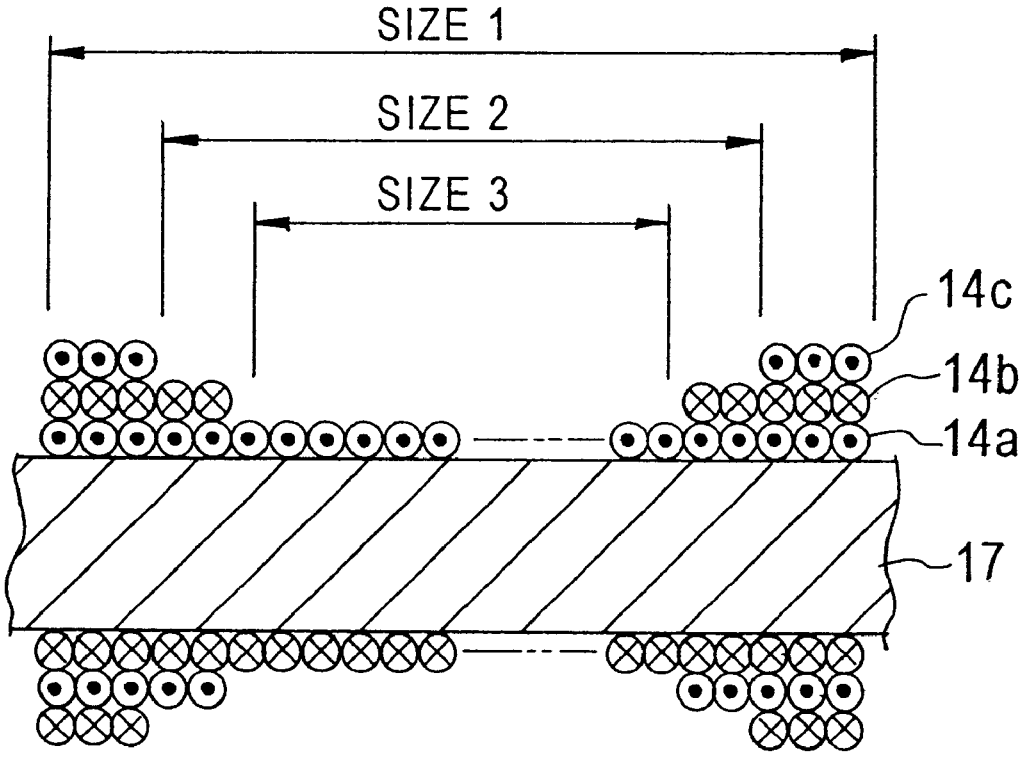
FIG. 8 is a fragmentary sectional view illustrating a coil section of an induction-heating fusion device according to EMBODIMENT 3 of the present invention.

FIG. 8 is a fragmentary sectional view illustrating a coil section according to EMBODIMENT 3.

As shown, this embodiment includes first induction coil 14*a* having a coil length equal to the maximum sheet width and wound around core 17, second induction coil 14*b* wound in a direction opposite to the winding direction of the first induction coil 14*a* and provided in the opposite end portions only, and third induction coil 14*c* wound in the same direction as the winding direction of the first induction coil 14*a* and provided only in endmost parts of the opposite end portions.

Figure 9:
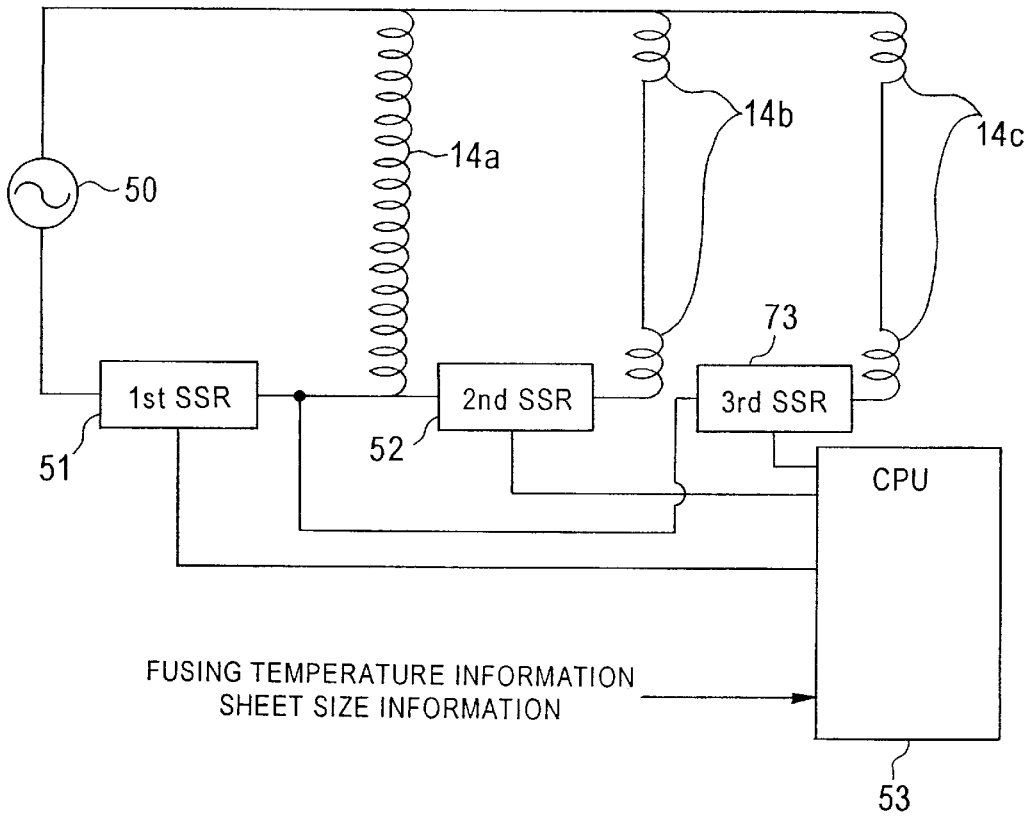
FIG. 9 is a diagrammatic view of a power supply circuit in the induction-heating fusion device according to EMBODIMENT 3.

FIG. 9 illustrates a circuit for supplying power to these coils.

As shown, this circuit includes first SSR 51 for controlling power supply to the first induction coil 14*a*, second SSR 52 for controlling power supply to the second induction coil 14*b*, and third SSR 73 for controlling power supply to the third induction coil 14*c*. Switching of each SSR is achieved in response to a signal from the CPU 53 as in EMBODIMENT 1. When these SSRs are turned on, current passes through all these coils in the same direction. Accordingly, the second induction coil 14*b* that is wound reversely to the winding direction of the first induction coil 14*a* is excited in a direction opposite to the excited direction of the first induction coil 14*a*, while the third induction coil 14*c* that is wound in the same direction as the first induction coil 14*a* is excited in the same direction as the excited direction of the first induction coil 14*a*.

When a sheet having the maximum width (size 1) is coming, the CPU 53 turns the first SSR 51 as well as the third SSR 73 on (while the second SSR is off). By doing so, the opposite end portions are induction-heated more intensively than the central portion due to the third induction coil 14*c* excited in the same direction as the excited direction of the first induction coil 14*a*. Accordingly, a temperature decrease in the opposite end portions can be prevented though the coil length is equal to the maximum sheet width, thereby achieving uniform fusion over the entire sheet.

When a sheet having a slightly smaller size (size 2) than the maximum sheet width is coming, the CPU 53 turns the first SSR 51 on and the second and third SSRs 52 and 73 off. By doing so, the temperature decreases spontaneously in the opposite end portions because the coil length is equal to the maximum sheet width, thereby avoiding an excessive temperature rise in the sheet-nonpassing zone defined when such a smaller-size sheet is passed.

When a small-size sheet (size 3) is coming, the CPU 53 turns the first SSR51 as well as the second SSR 52 on (while the third SSR is off). By doing so, induction heat generated in the sheet-nonpassing zone is weakened because the second induction coil 14*b* is excited in a direction opposite to the first induction coil 14*a*, thereby inhibiting an excessive temperature rise in the sheet-nonpassing zone.

EMBODIMENT 4

Figure 10:
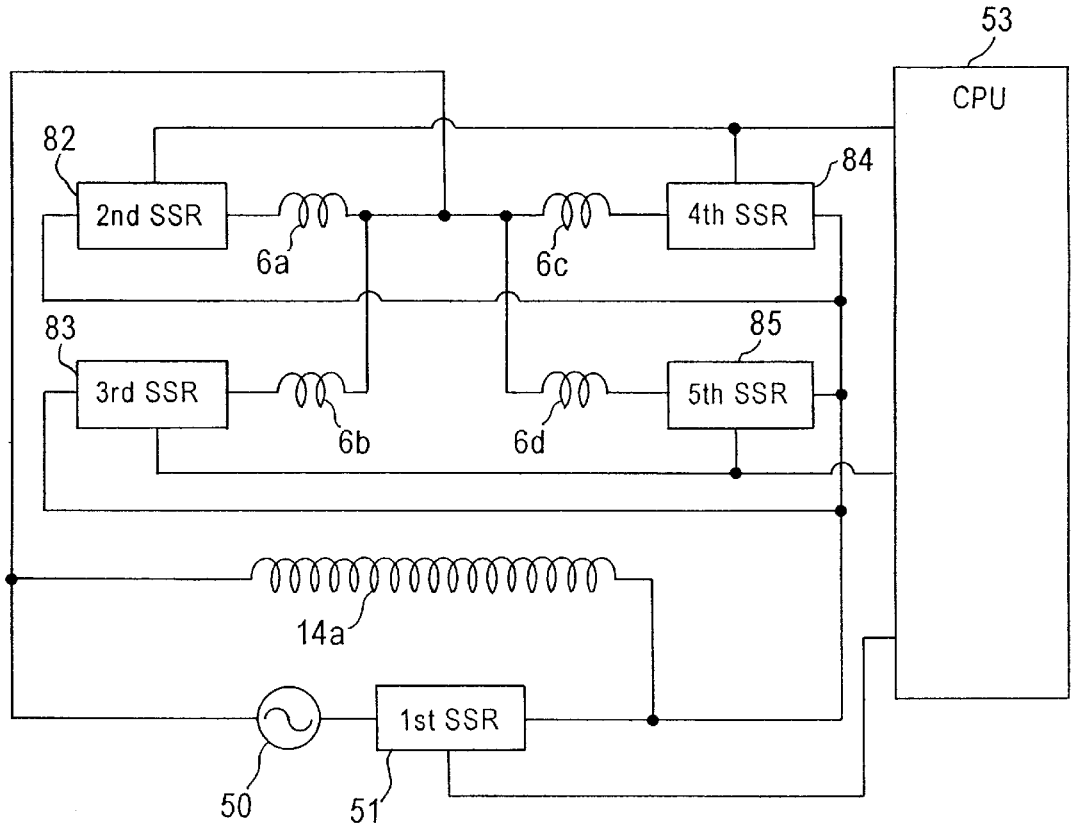
FIG. 10 is a diagrammatic view of a power supply circuit in an induction-heating fusion device according to EMBODIMENT 4.

FIG. 10 illustrates a power supply circuit configuration according to EMBODIMENT 4. It should be noted that this embodiment is common to EMBODIMENT 1 described above in the construction of the copying machine using this fusion device and the like and, hence, the description of such common constructions and features are omitted.

EMBODIMENT 4 includes first induction coil 14*a* having a coil length equal to the maximum sheet width, and two pairs of induction sub-coils provided on the opposite ends of the first induction coil 14*a*. Specifically, the induction sub-coils include a second induction coil 6*a* wound reversely to the winding direction of the first induction coil 14*a* and a third induction coil 6*b* wound in the same direction as the first induction coil 14*a*, which are provided on one end of the first induction coil 14*a*, and a fourth induction coil 6*c* wound in the same direction as the winding direction of the first induction coil 14*a* and a fifth induction coil 6*d* wound reversely to the winding direction of the first induction coil 14*a*, which are provided on the other end of the first induction coil 14*a*.

The first to fifth induction coils 14*a* and 6*a* to 6*d* are controlled by first to fifth SSRs 51 and 82 to 85, respectively.

As in EMBODIMENT 1, switching of each of the SSRs 82 to 85 is achieved in response to a signal from the CPU 53.

When a sheet having the maximum sheet width (size 1) is coming, the CPU 53 turns the first SSR 51 as well as the third and fourth SSRs 83 and 84 on (while the second and fifth SSRs are off). By doing so, current passes through the third and fourth induction coils 6*b* and 6*c* in the same direction as that passing through the first induction coil 14*a*. Accordingly, the third and fourth induction coils 6*b* and 6*c* are excited in the same direction as the excited direction of the first induction coil 14*a*, so that the opposite end portions are induction-heated more intensively than the central portion. Thus, a temperature decrease in the opposite end portions can be avoided though the coil length is equal to the maximum sheet width, thereby achieving uniform fusion over the entire sheet.

When a sheet having a slightly smaller width (size 2) than the maximum sheet width is coming, the CPU 53 turns the first SSR 51 on and all the second to fifth SSRs 82 to 85 off. By doing so, the temperature decreases spontaneously in the opposite end portions because the coil length is equal to the maximum sheet width, thereby inhibiting an excessive temperature rise in the sheet-nonpassing zone defined when such a smaller-size sheet is passed.

When a small-size sheet (size 3) is coming, the CPU 53 turns the first SSR51 as well as the second and fifth SSRs 82 and 85 on (while the third and fourth SSRs are off). By doing so, current passes through the second and fifth induction coils 6*a* and 6*d* in a direction opposite to that passing through the first induction coil 14*a*. Therefore, induction heat is weakened in the sheet-nonpassing zone because the second and fifth induction coils 6*a* and 6*d* are excited in a direction opposite to the excited direction of the first induction coil 14*a*, thereby inhibiting an excessive temperature rise in the sheet-nonpassing zone.

EMBODIMENT 5

Figure 11:
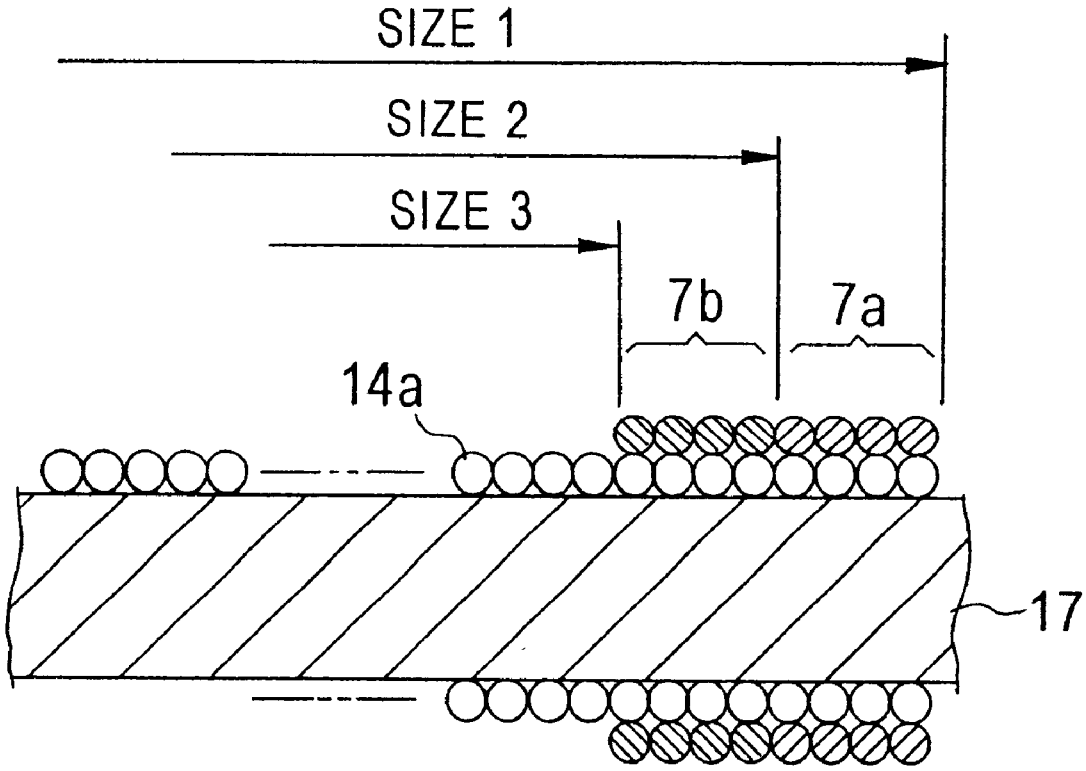
FIG. 11 is a fragmentary sectional view illustrating a coil section of an induction-heating fusion device according to EMBODIMENT 5 of the present invention.

FIG. 11 is a fragmentary sectional view illustrating a coil section of an induction-heating fusion device according to EMBODIMENT 5. It should be noted that this embodiment is common to EMBODIMENT 1 described above in the construction of the copying machine using this fusion device and the like and, hence, the description of such common constructions and features are omitted.

As shown, EMBODIMENT 5 includes first induction coil 14*a* having a coil length equal to the maximum sheet width, second induction coil 7*a* as a sub-coil provided on the opposite endmost portions of the first induction coil 14*a*, and third induction coil 7*b* as another sub-coil provided inwardly of the second induction coil 7*b*. Accordingly, the second and third induction coils 7*a* and 7*b* lie in the same layer.

When a sheet having the maximum sheet width (size 1) is coming, control of the sub-coils is performed such that the second induction coil 7*a* is excited in the same direction as the excited direction of the first induction coil 14*a* while the third induction coil 7*b* is not excited.

When a sheet having a slightly smaller width (size 2) than the maximum sheet width is coming, neither the second induction coil 7*a* nor the third induction coil 7*b* is excited.

When a small-size sheet (size 3) is coming, both the second and third induction coils 7*a* and 7*b* are excited in a direction opposite to the excited direction of the first induction coil 14*a*.

Such control performed in EMBODIMENT 5 enables a constantly stabilized fusing operation irrespective of the sheet size, as in the foregoing EMBODIMENTS 2 to 4.

Switching of the respective excited direction of the second and third induction coils 7*a* and 7*b* is performed by the use of a power supply circuit matching the respective winding direction of the second and third induction coils 7*a* and 7*b*.

EMBODIMENT 6

Figure 12:
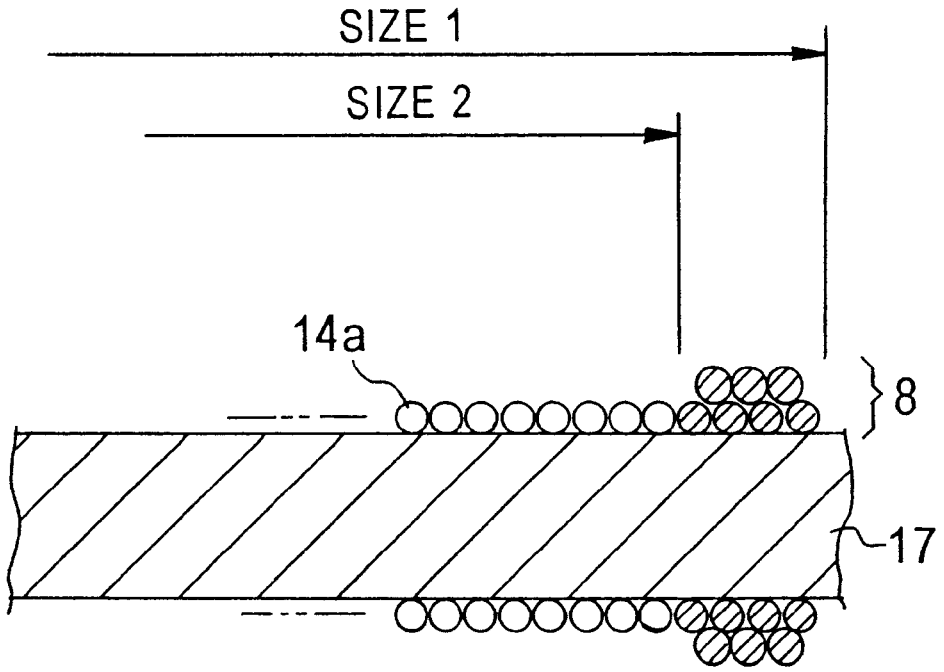
FIG. 12 is a fragmentary sectional view illustrating a coil section of an induction-heating fusion device according to EMBODIMENT 6 of the present invention.

FIG. 12 is a fragmentary sectional view illustrating a coil section of an induction-heating fusion device according to EMBODIMENT 6. It should be noted that this embodiment is common to EMBODIMENT 1 described above in the construction of the copying machine using this fusion device and the like and, hence, the description of such common constructions and features are omitted.

As shown, EMBODIMENT 6 includes first induction coil 14*a* having a coil length shorter than the maximum sheet width, and a second induction coil 8 (induction sub-coil) having a higher winding density than the first induction coil 14*a* and provided in the space between the first induction coil 14*a* and the extremity defined by the maximum sheet width. Thus, the portion corresponding to the second induction coil 8 is more intensively induction-heated than the portion corresponding to the first induction coil 14*a* with equal power.

When a sheet having the maximum sheet width (size 1) is coming, control is performed such that the second induction coil 8 is excited in the same direction as the excited direction of the first induction coil 14*a*. On the other hand, when a sheet having a smaller width (size 2) than the maximum sheet width is coming, the second induction coil 8 is not excited.

Such control performed in EMBODIMENT 6 enables a constantly stabilized fusing operation irrespective of the sheet size, as in the foregoing EMBODIMENTS 2 to 4.

EMBODIMENT 7

While any one of the foregoing EMBODIMENTS 1–6 is a fusion device of the type adapted for passage of sheets on a center line basis, the present invention is applicable also to a fusion device of the type adapted for passage of sheets on a one-side basis.

Figure 13:
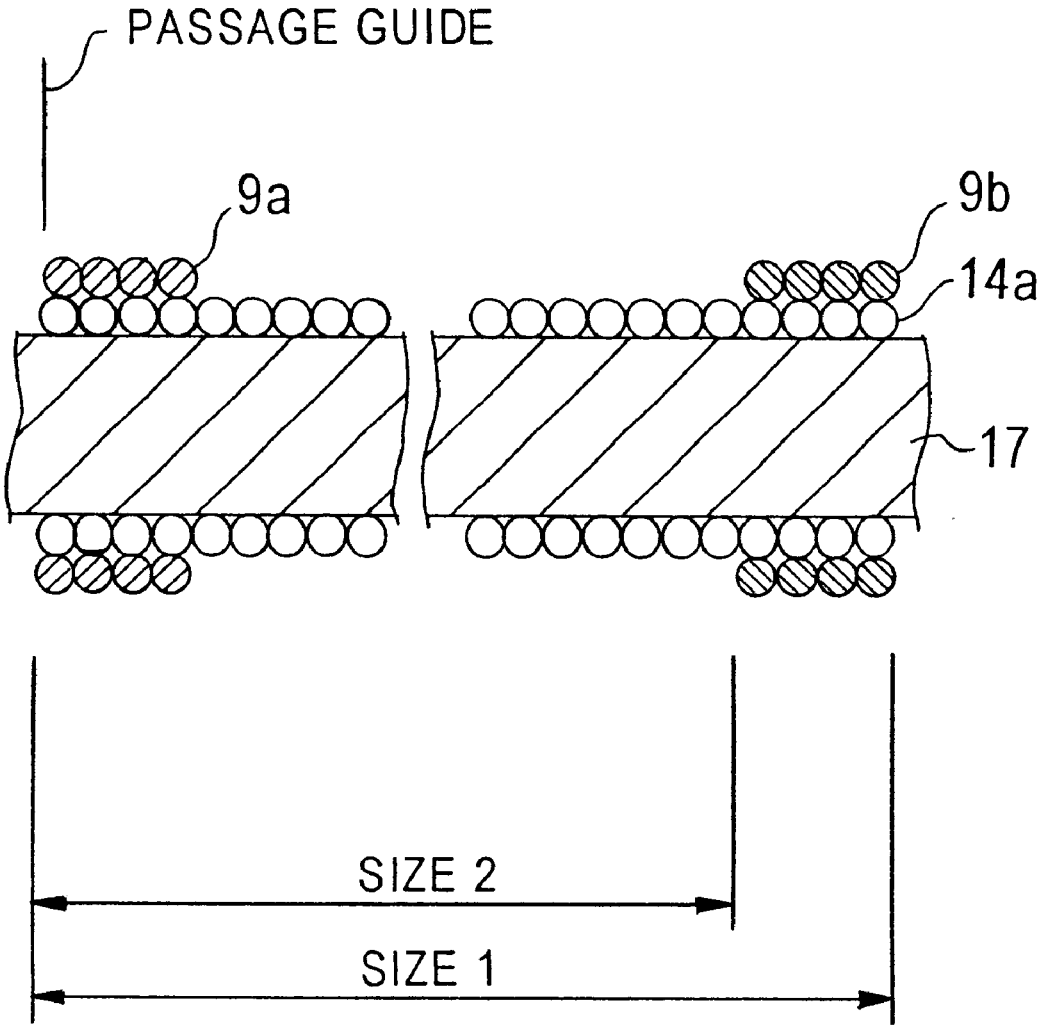
FIG. 13 is a fragmentary sectional view illustrating a coil section of an induction-heating fusion device according to EMBODIMENT 7 of the present invention.

FIG. 13 is a fragmentary sectional view illustrating a coil section of an induction-heating fusion device according to EMBODIMENT 7. It should be noted that this embodiment is common to EMBODIMENT 1 described above in the construction of the copying machine using this fusion device and the like and, hence, the description of such common constructions and features are omitted.

As shown, EMBODIMENT 7 includes first induction coil 14*a* having a coil length equal to the maximum sheet width, second induction coil 9*a* (induction sub-coil) provided on one end portion, on the passage guide side, of the first induction coil 14*a*, and third induction coil 9*b* (induction sub-coil) on the other end portion, on the side opposite to the passage guide, of the first induction coil 14*a*.

Irrespective of the size of a sheet coming, control of the second induction coil 9*a* is performed such that the second induction coil 9*a* is excited in the same direction as the excited direction of the first induction coil 14*a* unchangeably. By doing so, a temperature decrease in the portion corresponding to the second induction coil 9*a* can be prevented in spite of the first induction coil 14*a* having a coil length equal to the maximum sheet width.

The third induction coil 9*b* is excited in the same direction as the excited direction of the first induction coil 14*a* when a sheet having a width equal to the maximum sheet width (size 1) is coming. By doing so, a temperature decrease in a portion corresponding to the third induction coil 9*b* is prevented in performing a fusing operation over such a sheet having a width equal to the maximum sheet width. On the other hand, when a sheet having a smaller width (size 2) than the maximum width is coming, the third induction coil 9*b* is excited in a direction opposite to the excited direction of the first induction coil 14*a*. By doing so, an excessive temperature rise can be inhibited in the sheet-nonpassing zone defined when such a sheet is passed.

Although EMBODIMENT 7 is a fusion device of the type adapted for passage of sheets on a one-side basis, such control performed in EMBODIMENT 7 enables a constantly stabilized fusing operation irrespective of the sheet size, as in the foregoing EMBODIMENTS 2 to 6.

Switching of the excited direction of the third induction coils 9*b* is performed by the use of a power supply circuit matching the winding direction of the third induction coil 9*b*, as in the foregoing EMBODIMENTS.

While the embodiments to which the present invention is applied have been described, they are not limitative of the present invention. For example, instead of the temperature raising member 12 as the electrically conductive member fixed in any of the foregoing embodiments, it is possible to provide an arrangement comprising a support member made of a resin (electrically non-conductive material) to be used for the part corresponding to the temperature raising member 12 and an electrically conductive member to be used as a conveyor belt revolving around the support member.

In the present invention described above, at least one induction sub-coil is provided on an end portion of a main coil, and by switching the excited direction of such a sub-coil, the amount of induction heat generated in the end portion can be controlled. Thus, the present invention is capable of preventing an excessive temperature rise in a sheet-nonpassing zone defined in an end portion of the device when a small-size sheet undergoes a fusing operation, thereby ensuring a stabilized fusing temperature and inhibiting deterioration of the device components. Further, the present invention makes it possible to prevent a temperature decrease in the end portion of the device even when the main coil has a coil length equal to the maximum sheet width thereby ensuring a stabilized fusing operation over the entire width of a sheet. Thus, the present invention can contribute to down-scaling of the device.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An induction-heating fusion device comprising:

an electrically conductive tube;

an endless belt covering the tube;

a pressure member pressed toward the heat-generating member to define a nip in cooperation with the endless belt;

a permeable closed loop having a portion inserted into the tube;

a main coil continuously wound around the inserted portion of the closed loop along a peripheral wall of the tube and extending along the length of the tube;

a first sub-coil continuously wound around the inserted portion of the closed loop on an end portion of the tube along the peripheral wall of the tube; and a controller for controlling application of current to the main coil from a power source and application of current to the first sub-coil from the power source.

2. The induction-heating fusion device according to claim 1, wherein the controller controls the application of current to the first sub-coil depending on the width of a sheet carrying a toner image and passing through the nip.

3. The induction-heating fusion device according to claim 2, wherein:

the main coil is wound around the closed loop over a length substantially equal to the width of a first standardized sheet having a maximum sheet width and passing through the nip;

the first sub-coil is wound around the main coil in an overlapping fashion to a length corresponding to a sheet-nonpassing zone defined when a second standardized sheet having a smaller width than the maximum width passes through the nip;

and the controller causes alternating current to pass through the main coil while causing alternating current to pass through the sub-coil constantly in a direction opposite to that passing through the main coil when the second standardized sheet passes through the nip.

4. The induction-heating fusion device according to claim 2, wherein:

the main coil is wound around the closed loop over a length substantially equal to the width of a first standardized sheet having a maximum sheet width and passing through the nip;

the first sub-coil is wound around the main coil in an overlapping fashion to a length corresponding to a sheet-nonpassing zone defined when a second standardized sheet having a smaller width than the maximum sheet width passes through the nip;

and the controller causes alternating current to pass through the main coil while causing alternating current to pass through the first sub-coil constantly in a same direction as that passing through the main coil when the first standardized sheet passes through the nip.

5. The induction-heating fusion device according to claim 2, further comprising a second sub-coil continuously wound around the inserted portion of the closed loop on an end portion of the tube along the peripheral wall of the tube, wherein:

the second sub-coil is wound around the main coil in an overlapping fashion to a length corresponding to a sheet-nonpassing zone defined when a third standardized sheet which is smaller than the first standardized sheet and larger than the second standardized sheet in width passes through the nip;

and when the first standardized sheet passes through the nip, the controller causes alternating current to pass through the main coil while causing alternating current to pass through the second sub-coil constantly in a same direction as that passing through the main coil, and when the third standardized sheet passes through the nip, the controller causes alternating current to pass through the main coil only.

6. An induction-heating fusion device comprising:

an electrically conductive hollow member;

an iron core forming a closed loop and having a portion inserted into a hollow portion of the electrically conductive member;

a main coil spirally wound around the inserted portion of the iron core along an internal wall of the electrically conductive member; and a first sub-coil continuously wound around the inserted portion of the iron core along the internal wall of the electrically conductive member, wherein the main coil and the sub-coil cause the electrically conductive member to generate induction heat when applied with alternating current.

7. The induction-heating fusion device according to claim 6, wherein the first sub-coil is wound around the main coil in an overlapping fashion.

8. The induction-heating fusion device according to claim 7, wherein the direction of current passing through the first sub-coil is constantly opposite to that of current passing through the main coil.

9. The induction-heating fusion device according to claim 8, wherein the first sub-coil and the main coil are each applied with alternating current.

10. The induction-heating fusion device according to claim 7, further comprising a first switch for switching the direction of current passing through the first sub-coil into a direction as same as or opposite to the direction of current passing through the main coil constantly.

11. The induction-heating fusion device according to claim 6, further comprising a second sub-coil spirally wound around the inserted portion of the iron core along the internal wall of the electrically conductive member.

12. The induction-heating fusion device according to claim 11, wherein the second sub-coil is wound around the first sub-coil in an overlapping fashion.

13. The induction-heating fusion device according to claim 12, wherein the first sub-coil is wound around the main coil in an overlapping fashion.

14. The induction-heating fusion device according to claim 12, wherein the first sub-coil is wound in a side-by-side relationship with the main coil.

15. The induction-heating fusion device according to claim 11, wherein the first and second sub-coils are wound around the main coil in an overlapping fashion and are disposed in a side-by-side relationship with each other.

16. A fusion device comprising:

a sheet conveying mechanism for conveying a sheet to be subjected to fusion processing along a first direction;

a hollow electrically conductive member extending along a second direction perpendicular to the first direction of sheet conveyance so as to directly or indirectly come in contact with the sheet being conveyed;

an iron core arranged within a hollow space of the electrically conductive member, the iron core extending along the same direction as the second direction;

a main coil wound around the iron core to cover a predetermined range of the iron core in the second direction; a sub-coil wound around the iron core to cover only opposed ends of the iron core and vicinity in the second direction; and a current applying circuit for applying current to the main coil and sub-coil so as to generate a magnetic flux which causes the electrically conductive member to generate an induction current circumferentially thereof.

17. The fusion device according to claim 16, wherein the sub-coil has a higher winding density than the main coil.

18. The fusion device according to claim 16, further comprising a switch for switching the direction of current passing through the sub-coil so that the sub-coil is excited in a direction as same as or opposite to an excited direction of the main coil.

19. The fusion device according to claim 18, further comprising a controller for controlling the switch depending on the size of a sheet to passing through the fusion device and/or the fusing temperature.

20. A fusion device for generating heat by applying current to a coil to cause an electrically conductive member to generate induction current, comprising:

an iron core extending across a sheet transport direction;

an electrically conductive member having an endless configuration in section and covering the iron core;

a main coil wound around the iron core within the endless configuration of the electrically conductive member for generating a magnetic flux which causes the electrically conductive member to generate an induction current circumferentially thereof, the main coil being wound for a first length substantially equal to an extending dimension of a first side of a first standardized sheet; and a sub-coil wound around the iron core within the endless configuration of the electrically conductive member main coil for generating a magnetic flux which causes the electrically conductive member to generate induction current circumferentially thereof, the sub-coil being wound around the iron core at the opposing ends of the main coil so that a sum of the length of the main coil and the sub-coil is substantially equal to an extending dimension of a first side of a second standardized sheet, greater than the extending dimension of the first side of the first standardized sheet, the first sides of the first and second standardizes sheets being the sides of the respective sheets that first encounter the fusion device.

21. The fusion device according to claim 20, wherein the sub-coil has a higher winding density than the main coil.

* * * * *